United States Patent [19]

Mazur

[11] 4,445,583

[45] * May 1, 1984

[54] COOLING FAN CONTROL

[75] Inventor: Joseph S. Mazur, Livonia, Mich.

[73] Assignee: Eaton Corporation, Cleveland, Ohio

[ * ] Notice: The portion of the term of this patent subsequent to Mar. 15, 2000 has been disclaimed.

[21] Appl. No.: 183,890

[22] Filed: Sep. 4, 1980

[51] Int. Cl.[3] ..... B60H 01/24

[52] U.S. Cl. ..... 180/68.1; 123/41.49; 123/41.65; 123/41.7; 180/68.4; 236/35; 237/12.3 A; 416/178; 417/362; 417/423 R; 474/12; 474/113

[58] Field of Search ..... 180/54 A, 68 R, 54 R, 180/297, 291; 474/113, 12, 15, 109, 114; 416/187, 178; 60/337; 123/41.12, 41.63, 41.65, 41.70, 41.49; 417/362, 423 R; 165/41, 44, 67, 122, 149; 98/2.07, 2.16; 237/12.3 A, 12.3 B, 12.3 R

[56] References Cited

U.S. PATENT DOCUMENTS

| | | | |
|---|---|---|---|
| 1,270,101 | 6/1918 | Basel | 237/12.3 B |
| 1,721,645 | 7/1929 | Sproles | 180/54 A |
| 2,173,661 | 9/1939 | Perrine | 474/12 X |
| 2,511,549 | 6/1950 | Simi | 180/54 A |
| 2,531,269 | 11/1950 | Herrington | 180/68 R |
| 2,680,490 | 6/1954 | Dafoe | 180/54 A |
| 3,018,667 | 1/1962 | Spietz | 474/109 |
| 3,599,504 | 8/1971 | Taylor | 474/12 |
| 3,613,645 | 10/1971 | Froumajou et al. | 180/54 R X |
| 3,630,003 | 12/1971 | Ashton et al. | 180/68 R X |
| 3,696,730 | 10/1972 | Masuda et al. | 180/54 A X |
| 3,856,100 | 12/1974 | Manning | 180/54 A |
| 3,884,316 | 5/1975 | Bowers | 474/12 X |
| 3,915,024 | 10/1975 | Mort | 180/68 R X |
| 3,918,547 | 11/1975 | Kramer et al. | 180/54 A |
| 4,007,999 | 2/1977 | Serizawa | 416/187 X |
| 4,175,388 | 11/1979 | Milbreath et al. | 60/337 |
| 4,376,424 | 3/1983 | Mazur | 123/41.12 |

FOREIGN PATENT DOCUMENTS

| | | | |
|---|---|---|---|
| 885222 | 12/1961 | United Kingdom | 123/41.65 |
| 2027139 | 2/1980 | United Kingdom | 474/15 |

*Primary Examiner*—Joseph F. Peters, Jr.
*Assistant Examiner*—Mitchell J. Hill
*Attorney, Agent, or Firm*—C. H. Grace; P. S. Rulon

[57] ABSTRACT

Two embodiments of V-belt tensioning devices are employed in a cooling system of a vehicle having an engine (20) transversely mounted for rocking motion relative the vehicle frame (42). The cooling system includes an engine cooling radiator (22) mounted forwardly of the engine and substantially parallel to the rotational axis of the engine crankshaft; a cross-flow fan (24) having a rotational axis fixed against movement relative to the vehicle frame, substantially parallel to the crankshaft axis, and between the crankshaft axis and the plane of the radiator; a V-belt drive (32, 34 36) for rotating the fan in response to rotation of the crankshaft; and the two embodiments of the tensioning devices which maintain the V-belt tension as the distance between the crankshaft and fan axes varies in response to rocking motion of the engine. In one embodiment the tensioning device (90) is a split pulley (36). In the other embodiment the tensioning device (108) is a spring loaded idler pulley (110).

11 Claims, 7 Drawing Figures

FIG. 1.
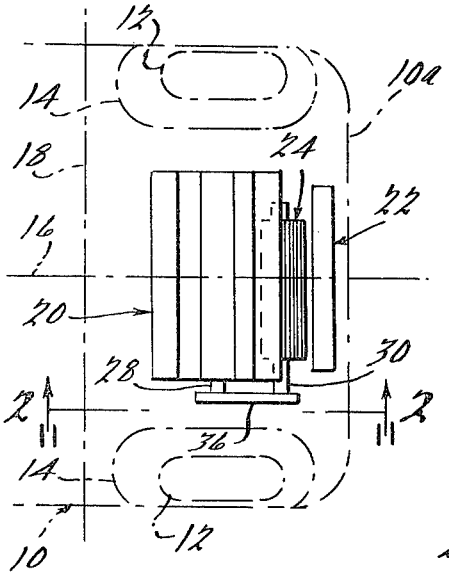
FIG. 2.
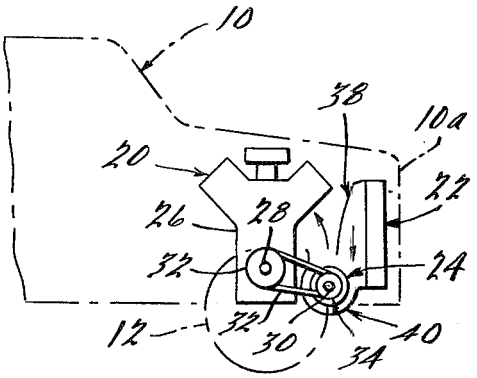
FIG. 7.
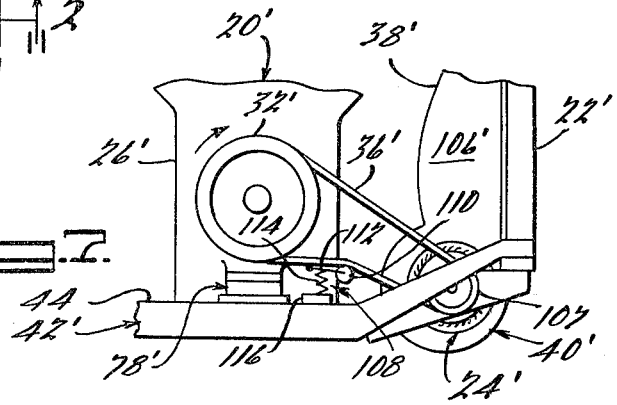
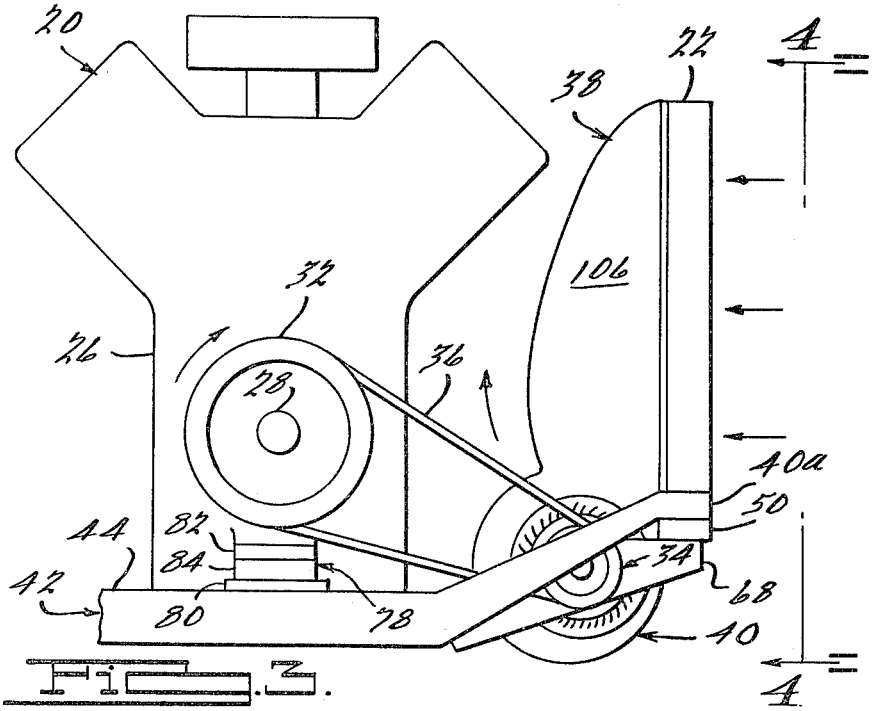
FIG. 3.

COOLING FAN CONTROL

CROSS-REFERENCE TO RELATED APPLICATIONS

This application is related to U.S. Pat. Nos. 4,372,409 issued Feb. 8, 1983 and 4,376,424 issued Mar. 15, 1983. Both of these patents are assigned to the assignee of this application.

FIELD OF THE INVENTION

This invention relates to vehicle engine cooling and, in particular, to a mechanical drive arrangement for a vehicle having a transversely mounted engine.

BACKGROUND OF THE INVENTION

The current proliferation of front wheel drive vehicles with liquid-cooled engines mounted transverse to the longitudinal axis of the vehicle has complicated traditional cooling fan drive arrangements wherein the engine is mounted parallel to the longitudinal axis. Vehicles with either longitudinally or transversely mounted engines preferably have the radiator positioned forwardly of the engine and in a plane transverse to the longitudinal axis since such positioning provides direct access for ambient air flow through the radiator, particularly ram air, and since space for the radiator is readily provided with such positioning.

In vehicles with longtidudinally mounted engines, forwardly mounted radiators, and axial flow fans mounted therebetween, the axial flow fans are conveniently mounted on the front of the engines with the rotational axes of the fans positioned parallel to the engine crankshaft axes. With such positioning the fans are readily driven by mechanical drives, such as belts driven by pulleys mounted on forward projections of the engine crankshafts. Such drive arrangements are simple, reliable, relatively inexpensive, and last, but not least, relatively efficient. In vehicles with radiators mounted forward of the engines and parallel to the rotational axes of the engine crankshafts (as is the case with transverse engine vehicles), axial flow fans cannot be readily mounted on the engines with the rotational axes of the fans parallel to the crankshaft axes and cannot be readily driven by mechanical drive arrangements such as belts driven by pulleys mounted on projections of the engine crankshafts, since the necessary space for such arrangements is not available. Hence, vehicles with transversely mounted engines and radiators mounted forward of the engines and parallel to the axes of the engine crankshafts, for the most part, now use electric motors to drive the fans. The electric motors are in general more expensive than mechanical drive arrangements and are believed to be less reliable. Further, since the electric motors are price sensitive per unit horsepower and are substantially less efficient than mechanical drives, some vehicle manufacturers have increased the size of the radiators to reduce motor size and have spent considerable time developing more efficient fans to further reduce motor size.

One prior art reference, U.S. Pat. No. 3,696,730 issued Oct. 10, 1972, schematically discloses a transverse engine vehicle with a forwardly mounted radiator and several embodiments of mechanically driven fans. One embodiment discloses a centrifugal fan with an axial inlet and a radial outlet mounted on one end of the engine. The other embodiments disclose axial flow fans transversely disposed with respect to one end of the engine and with the rotational axes of the fans either in line with the engine crankshaft axis or forward thereof. All of these embodiments require transverse offsetting of the radiators and/or the engines, transverse offsetting of the fans, bulky ducts for directing air to and from the fans, and tortuous flow paths for the air. Transverse offsetting of the radiators though possible even in relatively small cars is not desirable since it interferes with headlight and fender mounting unless the front of the vehicle is extended to provide additional room. Transverse offsetting of transversely mounted engines is undesirable since it upsets vehicle weight distribution and, as a practical matter, there is insufficient transverse space for such offsetting in passenger vehicles with forwardly mounted transverse engines. Likewise, there is insufficient transverse space for transverse offsetting or positioning of the fans at one end of the engines. Further, the bulky or large ducts for directing the air to and from the fans would at best be difficult to install in the limited space available in such vehicles.

SUMMARY OF THE INVENTION

An object of this invention is to provide a compact and efficient cooling fan which is readily driven by a vehicle engine.

Another object of this invention is to provide such a fan which is readily installed in a vehicle having a forwardly mounted transverse engine.

According to a feature of the invention, a vehicle includes an engine having a crankshaft mounted therein for rotation about an axis, a fan having an input shaft defining the rotational axis of the fan, means mounting the engine and fan with the axes transversely spaced apart and substantially parallel to each other and allowing the spaced apart distance to vary in response to variations in engine load, a mechanical drive having a drive belt connecting the input shaft with the crankshaft, and tensioning means for maintaining a relatively constant tension on the belt as the spaced apart distance varies.

BRIEF DESCRIPTION OF THE DRAWINGS

A cross-flow cooling fan and mechanical drive arrangement with tensioning means are shown in the accompanying drawing in which:

FIG. 1 is a downwardly looking schematic of the invention disposed in a partial outline of a vehicle;

FIG. 2 is a vertical schematic of the invention looking along line 2—2 of FIG. 1;

FIG. 3 is an enlargement of a portion of FIG. 2, still in schematic form but with substantially more detail;

FIG. 7 is a modified schematic of the invention shown.

Figure 4:
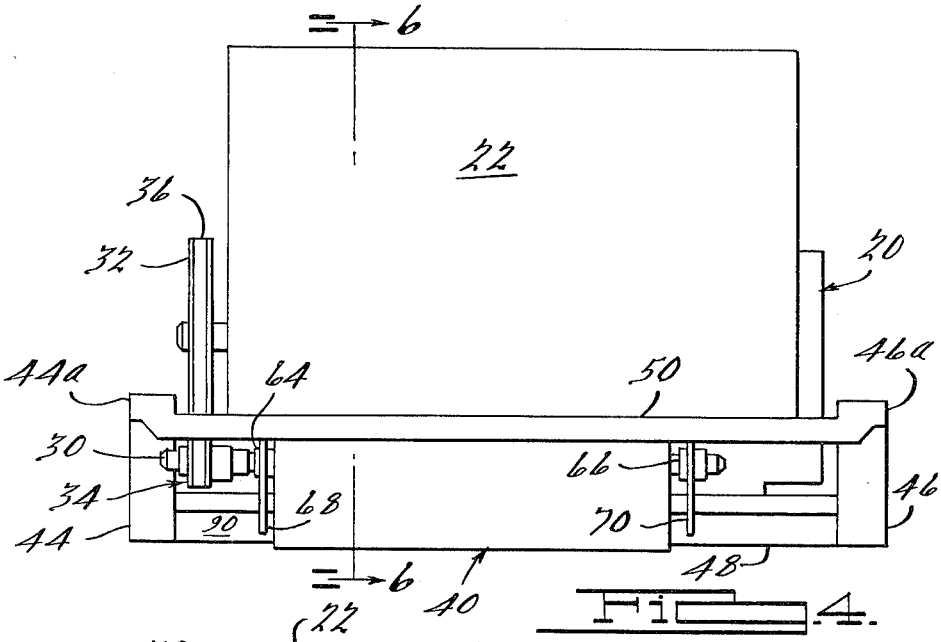
FIG. 4 is a vertical schematic of the invention looking along line 4—4 of FIG. 3.

Certain terminology referring to specific types of components, direction, motion, and the relationship of components to each other will be used in the following description. This terminology is for convenience in describing the invention and should not be considered limiting unless explicitly used in the claims.

DETAILED DESCRIPTION OF THE DRAWINGS

FIG. 1 is a plan view of a front portion of a vehicle with the vehicle body 10, front wheels 12, and inner fenders 14 shown in phantom lines. The vehicle grille or front 10*a* faces the direction of forward vehicle motion. Axis line 16 represents the longitudinal axis of the vehicle and axis line 18 represents the transverse axis of the vehicle. Within body 10 is a transversely mounted engine 20 of the liquid-cooled type, a radiator 22 mounted behind the grille and forward of the engine with the grille width substantially parallel to the transverse axis, and a cross-flow fan 24 mounted on the discharge or rear side of the radiator. The block outline representing radiator 22 may also include an air-conditioning evaporator. Cross-flow fans, which are sometimes referred to as double traverse fans or tangential fans are species of centrifugal fans but differ from commonly known centrifugal fans in that they pump air radially inward and outward such that the air passes chordally across the circumferential extent of the fan, whereas commonly known centrifugal fans pump air radially inward and then axially outward or vice versa. For a given fan speed and pumping capacity cross-flow fans are generally smaller in diameter than commonly known centrifugal fans, whereby cross-flow fans are more readily positioned in limited spaces. Further, since a cross-flow fan pumps air chordally across the circumferential extent of the fan, the fan and its inlet and outlet ducts may be positioned directly behind the radiator, whereby the packaging of the cross-flow fan and its ducts may be made substantially more compact than the packaging of the commonly known centrifugal fan and its ducts.

Looking now at both FIGS. 1 and 2, engine 20, which may drive the front wheels and/or the rear wheels, includes a housing or block 26 having an unshown crankshaft mounted therein for rotation about an axis substantially parallel to the transverse axis. A shaft 28, which projects from block 26, may be an extension of the crankshaft or a shaft driven by the crankshaft. The cross-flow fan 24 includes an input shaft 30, defining an axis about which the fan rotates. The fan is driven by a mechanical drive assembly including a V-pulley 32 fixed to shaft 28, a split V-pulley 34 fixed to rotate with input shaft 30, and a V-belt 36. In FIG. 2, cross-flow fan 24 is shrouded by an inlet duct 38 and an outlet duct 40. Ducts 38 and 40 are not shown in FIG. 1 so that the position of the cross-flow fan with respect to the radiator and engine may be readily seen.

Figure 5:
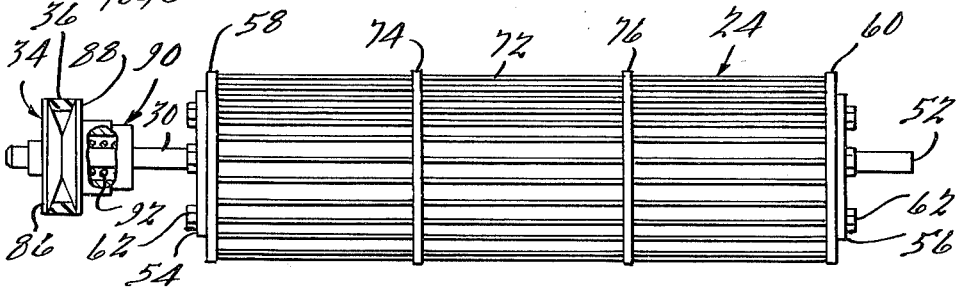
FIG. 5 is an enlarged view of a cross-flow fan, partially shown in the previous figures, with a drive assembly mounted on the input shaft of the fan.

Looking now at FIGS. 3–5, which are more detailed schematics of the embodiment of FIGS. 1 and 2 and starting with FIGS. 3 and 4, engine 20 and radiator 22 are conventionally mounted on the vehicle frame 42. Frame 42 includes two horizontal, longitudinally extending rails 44 and 46 and a transverse cross member 48. Forward of the engine, rails 44 and 46 taper down and are bent upward at about a 30° angle. The forward ends 44*a* and 46*a* of the rails provide support for a transverse cross member 50 which supports the radiator. Cross member 50 may be formed integrally with the radiator. The radiator may be shock or vibration insulated from frame 42 by conventional rubber mounts which are not shown. But for all practical purposes, the radiator is fixed against movement relative to the frame.

As may be seen in FIGS. 4 and 5, cross-flow fan 24 includes the input drive shaft 30 at its left end and a shaft 52 at its right end. The shafts 30 and 52 are fixed to end plates 54 and 56 which are secured to end rings 58 and 60 of the fan by a plurality of bolts 62. Shafts 30 and 52 define the rotational axis of the fan and are journaled in bearings 64 and 66 carried by support members 68 and 70. Members 68 and 70 are fixed to cross members 48 and 50 such that the rotational axis of the fan is fixed relative to the frame, substantially parallel to the rotational axis of the engine crankshaft and behind the plane of the radiator with respect to the longitudinal axis. The outer circumferential extent of the fan is defined by a plurality of forwardly leaning blades 72 (herein twenty-four blades) which are circumferentially arrayed about the rotational axis of the fan. The forward leaning of blades 72 is most clearly shown in FIG. 6. The blades are supported at their ends by the end rings 58 and 60 and are supported therebetween by intermediate rings 74 and 76 with the axial extent of the blades parallel to the rotational axis and with the radial extent of the blades extending generally inward toward the rotational axis. The axial extent of the blades 72 preferably, but not necessarily, extend the full or (as herein) substantially the full width of the radiator, thereby providing a direct and low resistance air flow path from the radiator to the fan. As may be seen in FIG. 4, fan 24 is positioned somewhat offset with respect to the vertical center of the radiator. This offset positioning was done to minimize the length of input shaft 30 of the test fan. The test was conducted in a front wheel drive vehicle having a transversely mounted V-6 engine and a radiator about twenty-four inches wide. The test fan was about eighteen inches long and about six inches in diameter. A fan of the same capacity could be made by increasing the fan length and reducing the fan diameter.

Looking again at FIG. 3, engine 20 is conventionally mounted on frame 42 via mounts which allow the engine and crankshaft to rock or move transverse to the crankshaft axis in response to varying engine load, such rocking or transverse movement being reaction torque on the crankshaft. Only one engine mount 78 is shown. The mount includes metal plates 80 and 82 fixed respectively to rail 44 and block 26 and a rubber pad 84 bonded to the plates. Engine 20 rocks counterclockwise with respect to mount 78 in response to increasing engine load, thereby increasing the center distance between shafts 28 and 30 with increasing engine load.

Looking now at FIGS. 4 and 5, and in particular at FIG. 5, split pulley 34 includes pulley halves 86 and 88 and a tensioning means 90. Pulley half 86 is fixed against rotation and axial movement relative to shaft 30. Pulley half 88 is fixed against rotation relative to shaft 30 but is free to slide axially. Tensioning means 90 includes a helical spring 92 partially shown in a broken-away portion of a protective cover. Spring 92 biases pulley half 88 toward half 86, thereby resiliently reducing the width of the V-groove defined by the two halves. When the width of the V-groove is a minimum, pulley 34 presents a maximum diameter to V-belt 36. When engine 20 rocks counterclockwise and changes the center distance between shafts 28 and 30, the tension on V-belt 36 tends to increase. Hence, pulley half 88 moves axially against spring 92 to widen the V-groove and allows the V-belt to move deeper into the groove, whereby pulley 34 presents a reduced diameter to the V-belt to maintain a relatively constant tension on the V-belt. The change in the diameter presented to the V-belt by pulley 34 also changes the speed ratio between shaft 28 and 30. Hence, in the disclosed embodiment with pulley 34 mounted on input shaft 30 the rotational speed of fan 24 will increase with increasing engine load. By mounting pulley 34 on shaft 28 the fan speed will decrease with engine load.

Figure 6:
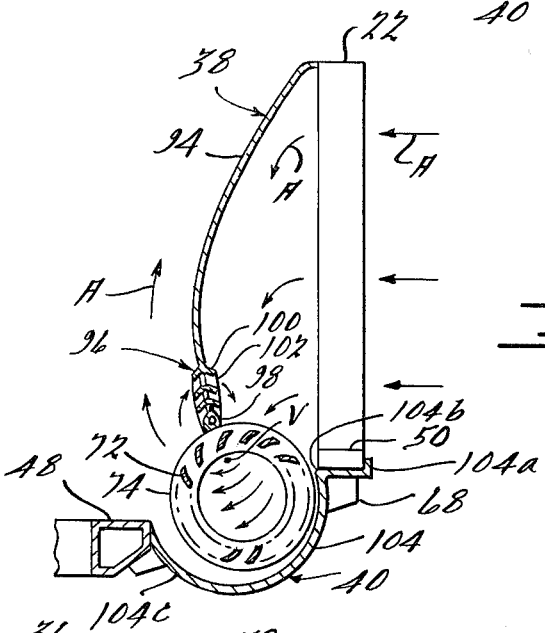
FIG. 6 is a sectioned portion of the invention looking along line 6—6 of FIG. 4.

Looking now mainly at FIG. 6, the inlet and outlet ducts 38 and 40 may be formed of sheet metal or plastic materials. The inlet duct 38 includes a sheet metal member 94 fixed at its upper end to the radiator and extending downward and generally rearward to about the eleven o'clock position of the fan wherein it defines or is integrally formed with a cascade or louver assembly 96. The assembly includes a rod or tubular member 98 closely spaced outward of the outer circumferential extent of the fan blades and extending substantially the full axial extent of the blades, a plurality of V-shaped louvers 100 equal in length to member 98, and a plurality of vertically extending spacers or strut pieces 102 between the tubular member and the louvers. The outlet duct 40 includes a sheet metal member 104 extending the full axial length of the fan blades and having a portion 104*a* fixed to cross member 50, a portion 104*b* closely spaced radially outward of the fan blades at about the three o'clock position of the fan, and an involute portion 104*c* extending from portion 104*b* to about the eight o'clock position of the fan where it is fixed to cross member 48. Ducts 38 and 40 are closed at their left and right ends by side members common to both ducts. One side member 106 is shown in FIG. 3. In the other figures, side member 106 is removed so that the cross-flow fan may be readily seen. Tubular member 98 and portion 104*b* define the circumferential boundaries separating the fan inlet area from the outlet area.

Looking now at the air flow through fan 24, a recirculation or back flow of air already transmitted to the inside of the fan or impeller is caused by an unavoidable internal vortex within the fan. The vortex is generally centered at a radial point traversed by the inner edges of the fan blades. The recirculating air or vortex size is responsible for energy losses which can be considerable. Fan efficiency, which is proportional to the total volume of the recirculating air, can be controlled by controlling the size of the vortex. The vortex within fan 24 is generally centered at about a point V and is controlled by cascade assembly 96. Several other means for controlling the vortex are known and can be found in *Fans,* Dr. -Ing. Bruno Eck, 1973 Vieweg & Sohn GmbH, Burgplatz 1, Braunschweig, which is incorporated herein by reference. Looking now at the air flow arrows A in FIG. 6, in general, the air flows in hook curved paths and in vertically extending planes which are generally parallel to the longitudinal axis of the vehicle. Air passes through the core of the radiator 22 to the inlet area of the fan where it is impelled radially inward by the blades 72 and chordally across the interior of the fan where it is then impelled radially outward by the blades to the discharge area. As may be seen, the radius of curvature of the air within the fan decreases in proportion to its proximity of the vortex center V. Due to the vortex and the upsweep of involute portion 104*c*, as the air leaves the fan it is impelled upward and to the right in a clockwise motion. A portion of this air passes through louvers 100 of the cascade assembly and back to the inlet area. The remainder of the air, due to the circular motion, forms a thin air stream over the width of the backside of sheet metal member 94, whereby the air readily flows through the confined space between the engine and sheet metal member 94 without need for an extended outlet duct which in the test vehicle would interfere with components on the vehicle. Instead of directing all of the discharge air upward and over the backside of sheet metal member 94, a portion of the discharge air may be directed under engine 20 by shortening involute portion 104*c*. For example, if all of the transverse length of involute portion 104*c* is terminated or cut away short of cross member 48, most of the discharge air will flow under the engine; if a portion or portions of the transverse length is cut away, only the air in the area of the cut-away portion or portions will flow under the engine.

In the alternative embodiment of FIG. 7, components, which are substantially the same as components in the other figures, are given the same reference numbers with the addition of a prime. Accordingly, engine 20' is mounted for rocking motion relative to frame 42', the rotational axis of fan 24' is fixed against movement relative to frame 42' so that the distance between shafts 28' and 30' varies with engine load, split pulley 34 is replaced with a conventional V-pulley 107, and tensioning of V-belt 36' is provided by a spring loaded idler pulley assembly 108. Assembly 108 includes a pulley or roller 110 rotatably mounted on a beam 112 pivotally mounted on the engine block or frame and a spring 114 reacting between the beam and a bracket 116 fixed to the engine or frame.

The preferred embodiments of the invention have been disclosed for illustrative purposes. Many variations and modifications of the preferred embodiments are believed to be within the spirit of the invention. To mention but a few of such variations, split pulley 34 could be mounted on shaft 28 and a conventional pulley, such as pulley 32 could be mounted on shaft 30, whereby the fan speed would decrease with increasing engine load; split pulleys could be mounted on both shafts 28 and 30, whereby the fan speed would remain substantially the same as engine load varies. Further, with respect to the embodiment of FIG. 7, the V-belt drive could be replaced by a cog belt or a serpentine belt with the tension on these belts maintained by the idler pulley assembly 108. The following claims are intended to cover the inventive portions of the invention and variations and modifications within the spirit of the disclosed invention.

What is claimed is:

1. In a vehicle of the type including a frame, an engine having a crankshaft mounted therein for rotation about an axis, means mounting the engine on the frame such that the engine and crankshaft rock transverse to the crankshaft axis in response to varying engine load, and an engine cooling fan having an input shaft defining an axis about which the fan rotates, the improvement comprising:

means mounting the fan with the fan axis laterally spaced from and substantially parallel to the crankshaft axis and fixed against movement relative to the frame, whereby the spaced apart distance between the fan and crankshaft axes varies in response to varying engine load; and drive means connecting the input shaft with the crankshaft, said drive means including first and second drive pulleys respectively rotatable about the crankshaft and input shaft axes and moveable relative to each other when said spaced apart distance between the input shaft and crankshaft axes varies, a single drive belt drivingly interconnecting the pulleys, and tensioning means for maintaining a relatively constant tension on said belt as said spaced apart distance varies.

2. In a vehicle of the type including a frame, an engine having a crankshaft mounted therein for rotation about an axis, means mounting the engine on the frame such that the crankshaft axis is disposed transverse to the longitudinal axis of the vehicle and such that the engine and crankshaft rock transverse to the crankshaft axis in response to varying engine load, and an engine cooling fan having an input shaft defining an axis about which the fan rotates, the improvement comprising:

means mounting the fan with the fan axis laterally spaced from and substantially parallel to the crankshaft axis and fixed against movement relative to the frame, whereby the spaced apart distance between the fan and crankshaft axes varies in response to varying engine load; and drive means connecting the input shaft with the crankshaft, said drive means including first and second drive pulleys respectively rotatable about the crankshaft and input shaft axes and moveable relative to each other when said spaced apart distance between the input shaft and crankshaft axes varies, a single drive belt drivingly interconnecting the pulleys, and tensioning means for maintaining a relatively constant tension on said belt as said spaced apart distance varies.

3. In a vehicle of the type including a frame, an engine having a crankshaft mounted therein for rotation about an axis, means mounting the engine on the frame such that the engine and crankshaft rock transverse to the crankshaft axis in response to varying engine load, and a device having a rotatable input shaft defining an axis about which a portion of the device rotates, the improvement comprising:

means mounting the device with the device axis laterally spaced apart and substantially parallel to the crankshaft axis and fixed against movement relative to the frame, whereby the spaced-apart distance between the input shaft and crankshaft axes varies in response to varying engine load; and drive means connecting the input shaft with the crankshaft, said drive means including first and second pulleys respectively rotatable about the crankshaft and input shaft axes and moveable relative to each other when said spaced apart distance between the input shaft and crankshaft axes varies, a single drive belt drivingly interconnecting the pulleys, and tensioning means for maintaining a relatively constant tension on said belt as said spaced-apart distance varies.

4. The vehicle of claims 1, 2, or 3 wherein said tensioning means includes;

an idler pulley disposed between said pulleys; and means biasing said idler pulley into contact with said single drive belt.

5. The vehicle of claims 1, 2 or 3, wherein said drive means includes:

a V-belt; and a V-belt pulley driven by the crankshaft and a V-belt pulley fixed to the input shaft, said pulleys connected together by said V-belt, and one of said pulleys being a split pulley biased by said tensioning means toward a position presenting a maximum diameter to said V-belt and presenting a reduced diameter in response to said spaced apart distance between the fan and crankshaft axes increasing.

6. The vehicle of claim 5, wherein said split pulley is fixed to said input shaft and wherein said distance increases with increasing engine load.

7. In a vehicle of the type including a frame; a forwardly positioned engine having a crankshaft mounted therein for rotation about an axis; means mounting the engine on the frame with the crankshaft axis transverse to the longitudinal axis of the vehicle and allowing the engine and crankshaft to move transverse to the axis of the crankshaft; a liquid cooling system for the engine having a radiator cooled by air passing therethrough, the radiator being disposed in a plane spaced from and substantially parallel to the crankshaft axis with the air discharge side of the radiator facing the engine; a cooling fan for directing air through the radiator, the fan having an input shaft defining an axis about which the fan rotates; the improvement comprising:

means mounting the fan with the fan axis transversely spaced from and substantially parallel to the crankshaft axis and fixed against movement relative to the frame, whereby the spaced distance between the crankshaft and fan axes varies with varying engine load;

drive means connecting the input shaft with the crankshaft, said drive means including a drive belt and tensioning means for maintaining a relatively constant tension on said belt as said spaced distance varies.

8. The vehicle of claim 7, wherein the fan is a cross-flow fan.

9. The vehicle of claims 7 or 8, wherein said tensioning means includes:

an idler pulley; and means biasing said pulley into contact with said drive belt.

10. The vehicle of claims 7 or 8 wherein said drive means includes:

a V-belt; and a V-belt pulley driven by the crankshaft and a V-belt pulley fixed to the input shaft, said pulleys connected together by said V-belt, and one of said pulleys being a split pulley biased by said tensioning means to a position presenting a maximum diameter to said V-belt and presenting a reduced diameter to said V-belt in response to said spaced distance between the fan and crankshaft axes increasing.

11. The vehicle of claim 10, wherein said split pulley is fixed to said input shaft and wherein said distance increases with increasing engine load.

* * * * *